US008935860B2

(12) United States Patent
Torres

(10) Patent No.: US 8,935,860 B2
(45) Date of Patent: Jan. 20, 2015

(54) SELF-TIGHTENING SHOE

(76) Inventor: George Torres, Dover Plains, NY (US)

( * ) Notice: Subject to any disclaimer, the term of this patent is extended or adjusted under 35 U.S.C. 154(b) by 471 days.

(21) Appl. No.: 13/433,783

(22) Filed: Mar. 29, 2012

(65) Prior Publication Data

US 2013/0104429 A1 May 2, 2013

Related U.S. Application Data

(60) Provisional application No. 61/552,559, filed on Oct. 28, 2011.

(51) Int. Cl.

| | |
|---|---|
| ***A43C 11/00*** | (2006.01) |
| ***A43B 5/04*** | (2006.01) |
| ***A43B 3/00*** | (2006.01) |
| ***A43C 1/00*** | (2006.01) |

(52) U.S. Cl.

CPC ..... *A43B 3/0005* (2013.01); *A43C 1/003* (2013.01); *A43C 1/00* (2013.01); *A43C 11/008* (2013.01)

USPC ..... 36/50.1; 36/138; 36/88

(58) Field of Classification Search

CPC ..... A43B 11/00; A43C 1/00; A43C 1/003; A43C 11/008; A43C 11/00; A43C 11/16

USPC ..... 36/50.1, 50.5, 51, 1, 132, 136, 138, 88, 36/93

See application file for complete search history.

(56) References Cited

U.S. PATENT DOCUMENTS

| | | | | |
|---|---|---|---|---|
| 5,983,530 | A * | 11/1999 | Chou | 36/50.1 |
| 6,032,387 | A * | 3/2000 | Johnson | 36/50.1 |
| 6,598,322 | B2 | 7/2003 | Jacques et al. | |
| 6,691,433 | B2 * | 2/2004 | Liu | 36/50.1 |
| 6,865,825 | B2 * | 3/2005 | Bailey et al. | 36/88 |
| 7,103,994 | B2 * | 9/2006 | Johnson | 36/50.1 |
| 7,204,041 | B1 * | 4/2007 | Bailey et al. | 36/29 |
| 7,661,205 | B2 | 2/2010 | Johnson | |
| 7,752,774 | B2 * | 7/2010 | Ussher | 36/50.1 |
| 8,046,937 | B2 | 11/2011 | Beers et al. | |
| 8,058,837 | B2 * | 11/2011 | Beers et al. | 320/108 |
| 8,421,822 | B2 * | 4/2013 | Odland et al. | 345/619 |
| 8,528,235 | B2 * | 9/2013 | Beers et al. | 36/137 |
| 2008/0054845 | A1 * | 3/2008 | Wang | 320/111 |

* cited by examiner

*Primary Examiner* — Jila M Mohandesi

(74) *Attorney, Agent, or Firm* — William H. Dippert; Eckert Seamans Cherin & Mellott, LLC

(57) ABSTRACT

A shoe have a sole and a shoe upper is provided with a mechanism for automatically tightening the shoe on a foot to a preset level of tightness that has been stored in memory. The wearer can select and change the level of tightness as desired.

19 Claims, 4 Drawing Sheets

SELF-TIGHTENING SHOE

CROSS-REFERENCE TO RELATED APPLICATION

This application claims priority from the U.S. Provisional Application No. 61/552,559 filed Oct. 28, 2011.

BACKGROUND OF THE INVENTION

The present invention relates to a self-tightening shoe; that is a shoe which can close itself to a desired value of tightness around a foot upon the press of a button.

The term "shoe" is used generically herein to encompass any types of footwear including leather shoes, sneakers, slippers, boots and the like.

The most common form of closure mechanism for a shoe is a lace, criss-crossing between the medial and lateral portions of the shoe upper, that is pulled tight around the instep of the foot and tied in a knot by the wearer. While simple and practical in functionality, such shoelaces need to be tied by hand and often retied as they naturally loosen around the wearer's foot. Young children who have not yet learned to tie a knot require assistance from an attentive parent or caregiver. Elderly people suffering from arthritis may find it painful or difficult. to pull shoelaces tight and tie knots in order to secure the shoes on their feet.

In order to alleviate this problem of tying shoelaces, shoes for children and adults have been provided with Velcro straps in lieu of the shoelaces. Such straps, extending from one side of the shoe are readily fastened to a complimentary Velcro patch secured to the other side of the shoe. However, such Velcro closures can frequently become detached, particularly in the case of athletic shoes and hiking boots, when excessive stress is applied. Moreover, Velcro closures can become worn, losing their capacity to close securely. Furthermore, many wearers find Velcro straps on footwear to he insufficiently tight and/or aesthetically unacceptable.

Numerous inventions, patented and unpatented, have been directed to solving the problems associated with shoelaces and other closure devices for shoes. For example, the U.S. Pat. No. 7,661,205 to Johnson discloses an "automated tightening shoe" of the type having criss-crossed laces which enables a user to pull a single tightening member at the heel of the shoe to tighten the laces. Once tightened to a desired value, the laces are secured by a mechanical latching mechanism until the mechanism is released.

The U.S. Pat. No. 6,598,322 to Jacques et al. teaches a shoe having laces connected to elongated shape memory alloy elements. When energised by an electric circuit, the shape memory elements shorten themselves and tighten the shoelaces. A push button, switch mounted on the shoe allows the user to manually activate an electronic switch to pass current through the shape memory elements causing them to heat sufficiently to reach their transformation temperature to tighten the laces.

SUMMARY OF THE INVENTION

It is a principal object of the present invention to provide a self-tightening shoe which, upon activation by the user, tightens itself on the user's foot to a preprogrammed, comfortable level of tightness.

It is a further object of the present invention to provide a self-tightening shoe with a memory, to enable a user to select and change the level of tightness as desired.

This object as well as other objects which will become apparent from the discussion that follows, are achieved, in accordance with the present invention, by providing a shoe having the following elements:

(a) a shoe sole;

(b) a shoe upper attached to the sole and having two opposite lateral sides and an opening between them for inserting a foot;

(c) at least one shoe strap, extending from one side of the shoe upper to the other, for tightening the shoe on a foot;

(d) an electric battery;

(e) at least one strap tightener, coupled to the battery and to one of the shoe straps, for tightening the respective shoe strap in response to a control signal;

(f) an electronic logic device, coupled to the battery and to each strap tightener, for producing a control signal for each strap tightener so as to shorten the length of the respective shoe strap to a desired value of tightness; and (g) an electronic memory, coupled to said logic device, for storing the desired value of tightness for each respective shoe strap and providing a representation of the desired value to said logic device.

As used herein, the term "shoe strap" is intended to include shoelaces, shoe straps, metal shoe buckles or any other type of closure device, The shoe may have only one shoe strap or multiple shoe straps which may be connected (1) between the two lateral sides of the shoe upper, (2) between one side of the shoe upper and the shoe sole on the opposite side, and (3) from one side of the shoe sole to the other. Any arrangement of the shoe strap which tends to close and tighten the shoe on a foot may be employed in connection with present invention. The shoe strap tightener, or strap tighteners when more than one shoe strap are provided, may be connected to one end of a shoe strap or to both of its opposite ends.

The strap tightener may be an electric motor powered by the battery or, as in the case of the aforementioned U.S. Pat. No. 6,598,322 it may be a shape memory element. Any type of strap tightener which is capable of tightening a shoe strap to a desired value of tightness is contemplated by the present invention.

The strap tightener, or the plurality of strap tighteners, is/are controlled by the logic device which preferably includes a programmed microprocessor and produces a control signal for each strap tightener.

According to the invention, the logic device is connected to a non-volatile memory which receives, stores and retrieves a desired value of tightness for each strap tightener and, in turn each respective shoe strap.

The logic device operates in response to commands entered manually into a small control panel on the shoe. The control panel may be capable of entering one or more of the following commands:

(1) Store the current value of tightness in memory as the desired value;

(2) Retrieve the desired value of tightness from memory;

(3) Set the value of tightness of the strap tightener to the stored desired value;

(4) Select all of the shoe straps;

(5) Select one or more of the numbered shoe straps;

(6) Tighten all the selected shoe strap(s); and (7) Loosen all the selected shoe strap(s).

The battery for the self-tightening shoe is preferably attached or built into the shoe sole. This battery is preferably rechargeable, and can be recharged either by plugging a wire from a battery charger into an electric jack built into the shoe or by magnetic induction, when the shoe is not in use. In the latter case, the shoe may be placed on a small platform which incorporates a flat induction coil. A corresponding coil built into the sole of the shoe receives energy by magnetic induction that is converted to direct current by a conventional diode bridge.

Alternatively, the battery may be charged by a piezo-electric transducer arranged in the sole of the shoe which is stressed by pressure and bending of the shoe when in use.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
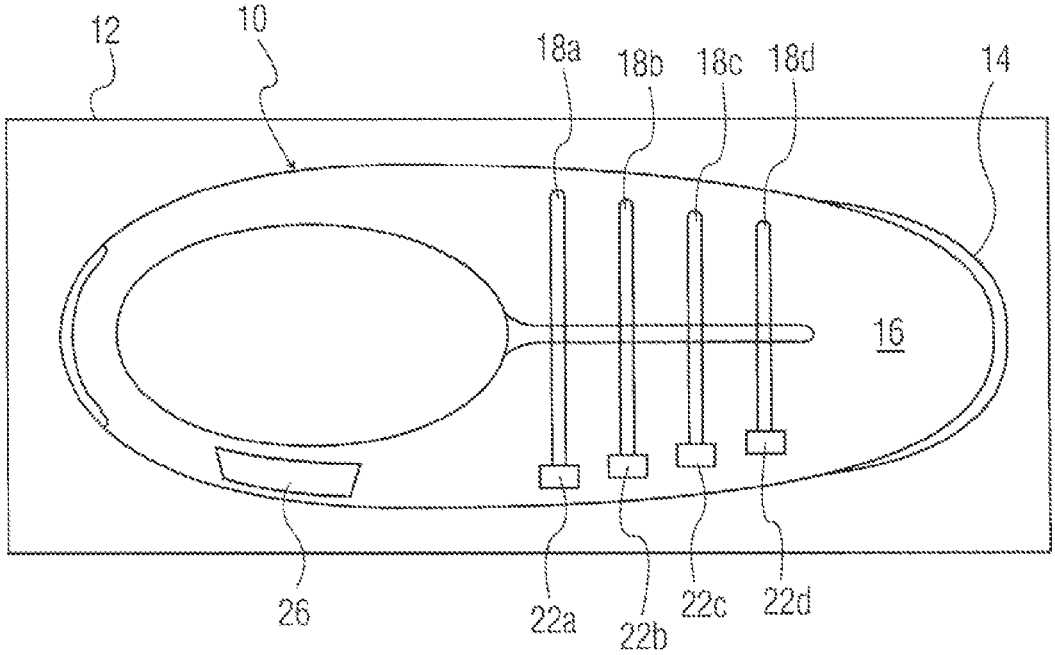
FIG. 1 is a top view of a self-tightening shoe according to a first preferred embodiment of the present invention.

The preferred embodiments of the present invention will now be described with reference to FIGS. 1-7 of the drawings. Identical elements in the various figures are designated with the same reference numerals.

Figure 2:
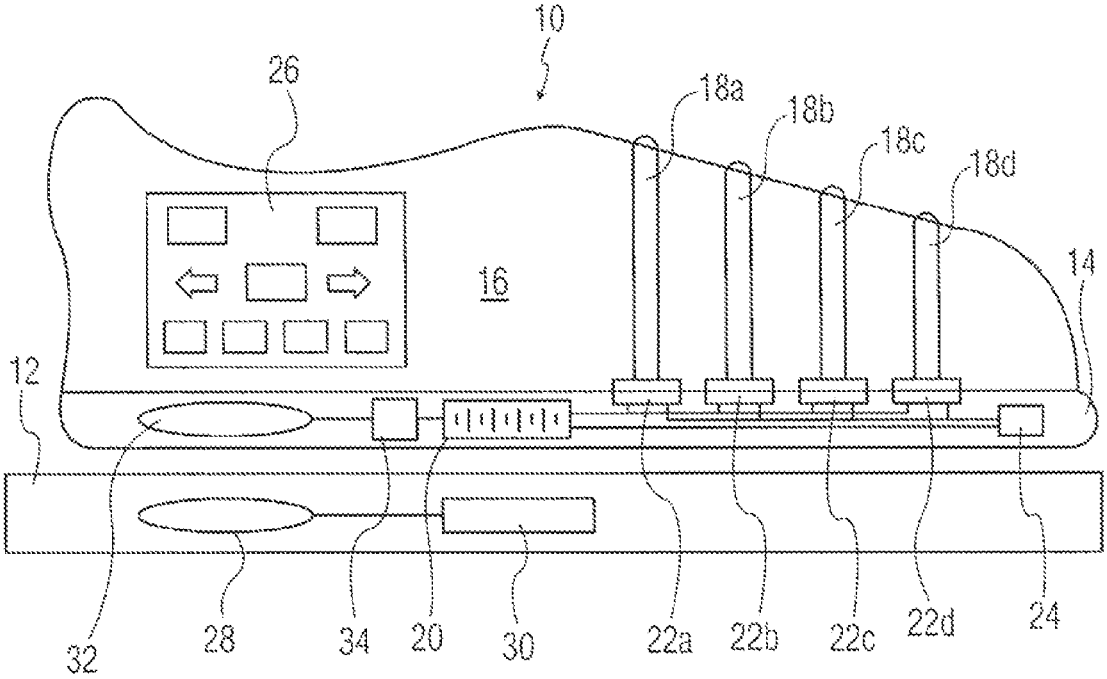
FIG. 2 is a side view of the shoe, disposed on an electric charger for recharging the shoe battery.

FIGS. 1 and 2 illustrate a shoe 10 disposed on a charging platform 12, both in top view (FIG. 1) and side view (FIG. 2). The shoe 10 includes a shoe sole 14, a shoe upper 16 affixed to the sole and having a right and left side. A plurality of shoe straps 18*a*, 18*b*, 18*c* and 18*d* extend from one side of the shoe upper to the other. The shoe further includes a shoe battery 20 and a plurality of shoe tighteners 22*a*, 22*b*, 22*c* and 22*d*, each coupled to the battery and to one of the shoe straps, for tightening the respective shoe strap in response to a control signal.

The control signals, for controlling each strap tightener and thus the tightness of each strap, are received from a logic device 24 embedded in the sole and connected to the battery 20. The logic device, which may be a microprocessor for example, incorporates a memory for storing a desired value of tightness for each respective shoe strap.

Each strap tightener may include an electronic switch (not shown), responsive to the control signal from the logic device, for controlling the electric battery power applied to the tightener.

The shoe 10 is also provided with a small control panel 26 at a convenient location, for example on the side of the shoe, for setting the desired tightness of each individual shoe strap and thereafter for tightening and loosening the shoe straps together.

The battery 20 is charged by placing the shoe on the platform 12 when not in use, to induction coil 28 in the platform receives AC power from a charger device 30 plugged into the power network and induces alternating current in a similar coil 32 embedded in the sole of the shoe. The current is rectified and smoothed by a device 34, having a diode bridge and smoothing capacitor, and supplied to the battery 20.

Figure 3:
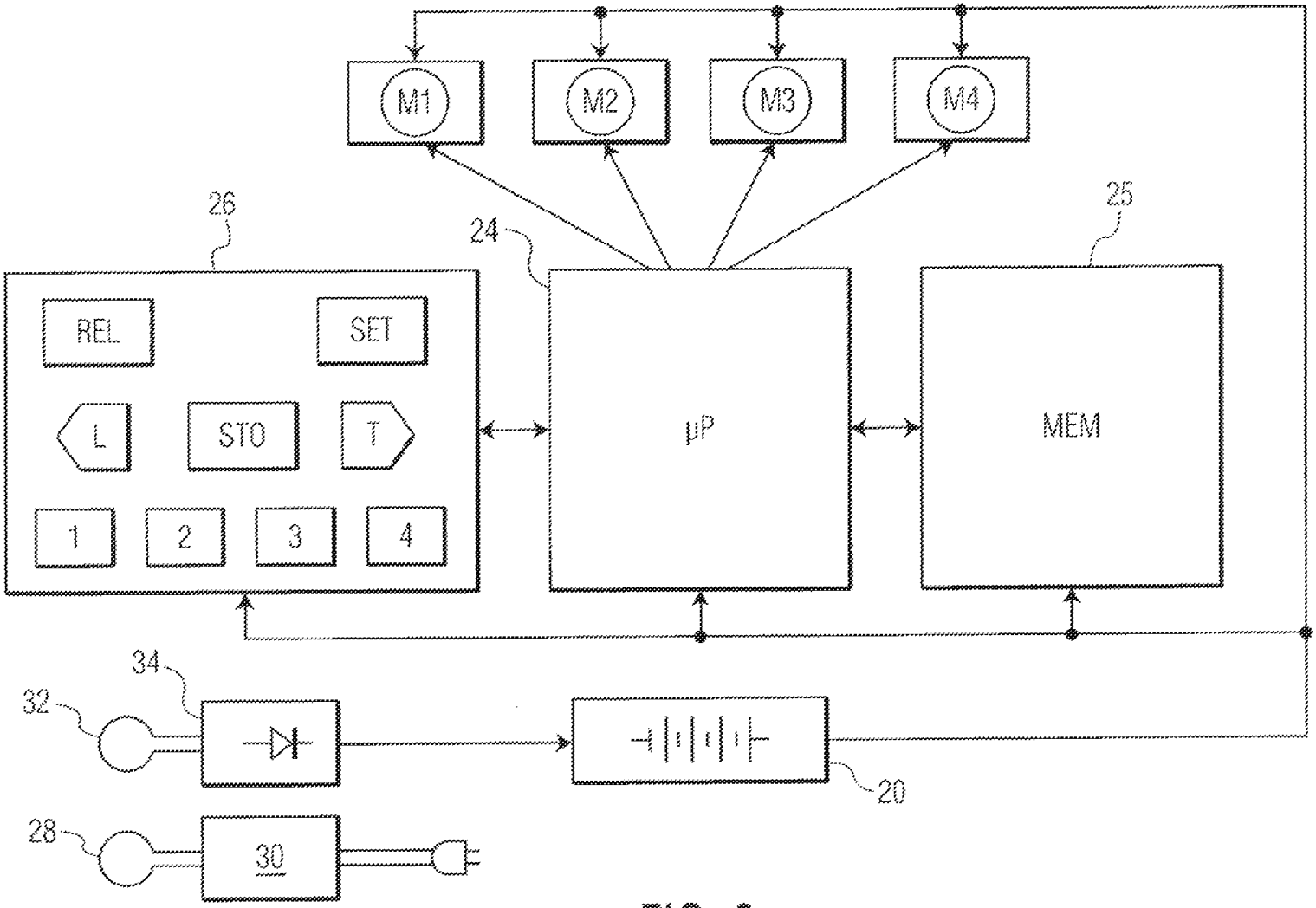
FIG. 3 is a block diagram of the electrical and electronic system employed in the shoe of FIGS. 1 and. 2.

The electrical power supply and electronic circuit are shown in detail in FIG. 3. The charger 30 supplies current to the induction coil 28 which, in turn, induces current in the parallel coil 32. The induced current is rectified and smoothed in the device 34 and passed to the battery 20. The battery 20 powers the electronic circuits as well as the electric motors M1, M2, M3 and M4 of the strap tensioners 22*a*, 22*b*, 22*c* and 22*d*, respectively.

The electronic circuits include the microprocessor 24, the associated non-volatile memory 25 and the control panel 26. The microprocessor receives control signals from the control panel 26 and operates the electric motors M1-M4 to tighten or release the shoe straps. The desired tightness of each show strap, when the shoe is in place on a wearer's foot, is stored in the memory 25 and retrieved on command.

The control panel 26 allows a wearer of the shoe to tighten the straps to a desired degree of tightness and then store this level of tightness in the shoe memory 24*a*. To accomplish this, the control panel has the following buttons:

REL—Release straps

SET—Set tightness of straps to desired value

L—Loosen straps (while holding button down)

T—Tighten straps (while holding the button down)

STO—Store current tightness as desired value

#1 through #4—The respective numbered straps and their tensioners.

These control buttons enable a wearer to issue the following commands:

(1) Release the straps;

(2) Store the desired value of tightness in memory;

(3) Set the current value of tightness as the stored desired value;

(4) Select all of the shoe straps;

(5) Select one or more of a plurality of shoe straps;

(6) Tighten the selected shoe strap(s); and (7) Loosen the selected shoe strap(s).

FIGS. 4-7 illustrate a second preferred embodiment of a self-tightening shoe according to the present invention. This shoe comprises four independent "tension control units." Each tension control unit includes a battery, an electronic two-way rotary motor, tension straps, and a push button control panel which has one button with the letter "T" for "tighten" and another with the letter "R" for "release." This is to control the wearer's customized, desired contour fit.

The most unique aspect of this footwear is that it sets itself to the customized, desired contour fit when the wearer's foot is inserted. The wearer will not have to tie or adjust the shoe because it "remembers" the desired fit on the wearer's foot and provides the exact customized, contour fitting that the wearer previously "pre-programmed" in when he/she first put on the shoe.

According to the invention, there is a "pressure sensor" tucked away in the heel of the shoe along with a "memory chip" which stores the desired fit; that is, the tension on the shoe straps. The shoe includes a "Set" button which allows a wearer to preset the customized, desired contour fit and to change and reset it again, if desired, at a later time.

In operation, the wearer makes sure the shoe's power switch is turned on before placing his/her feet into the shoe. To customize the shoe for a desired fit, the wearer presses the "Set" button located on the outside ankle area of the shoe. Thereafter, pressing each "T" button and/or "R" button on the "control panel" allows the wearer to adjust the shoe to the most comfortable fit. Once the wearer has completed the adjustments, he/she then presses the "Set" button again, locking in the desired fit for as long as the shoe is worn. Each time the wearer puts his/her foot into the shoe, it will retrieve the desired fit from memory and mil tighten itself automatically to adjust to this fit.

To remove the shoe, the wearer simply presses the "R" (release) buttons, one after the other from the top to the bottom, and the shoe automatically releases the tension of the straps to permit removal.

Figure 4:
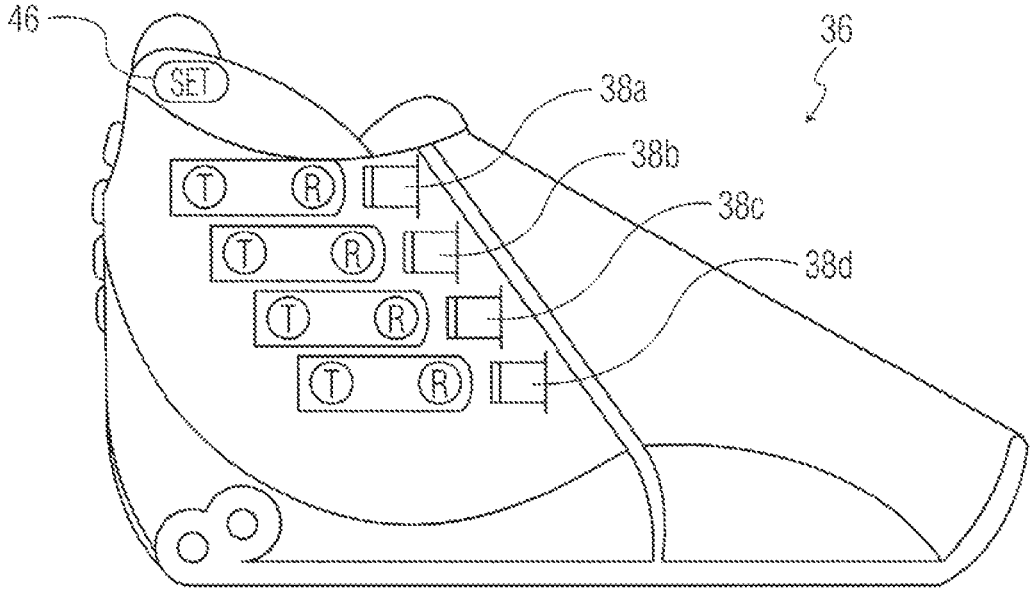
FIG. 4 is a side view of a self-tightening shoe according to a second preferred embodiment of the present invention.
Figure 5:
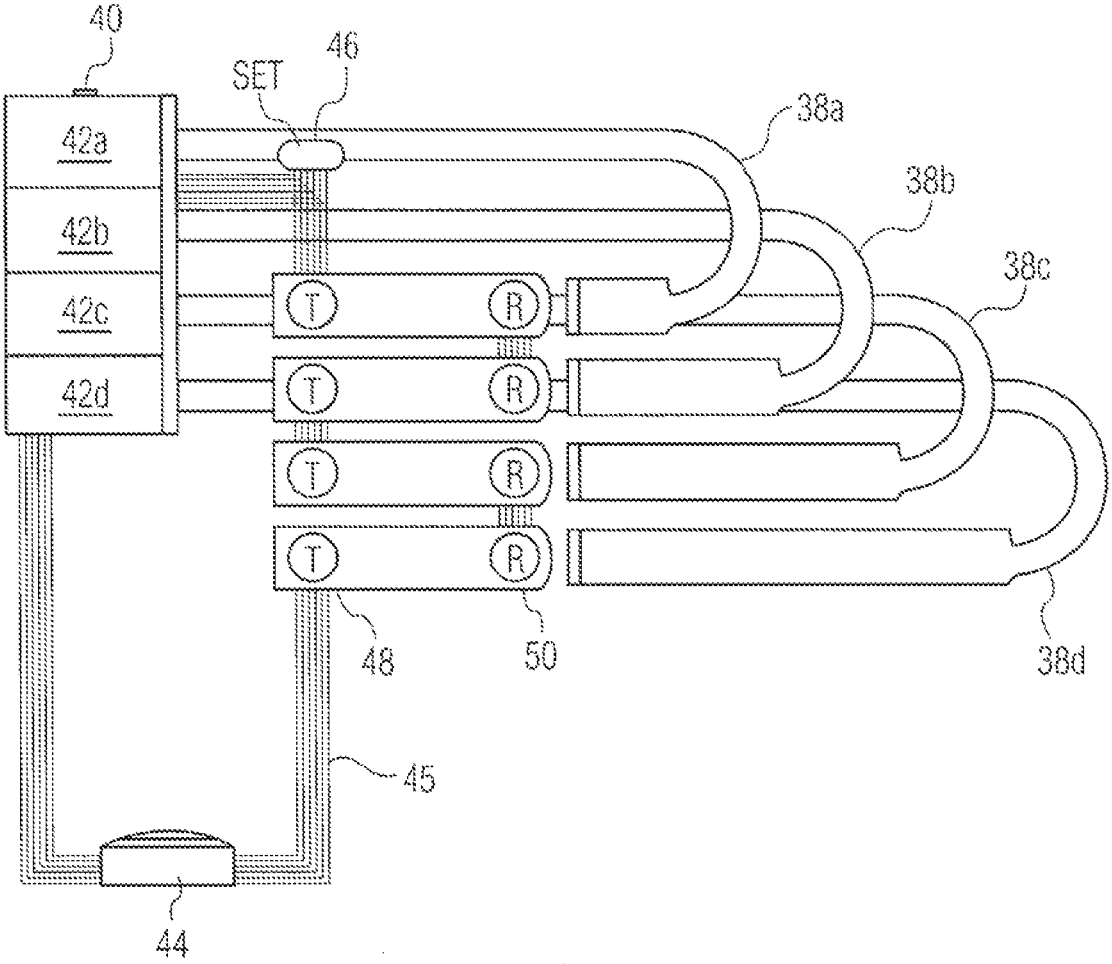
FIG. 5 is a representational diagram of the electrical and electronic system employed in the shoe of FIG. 4.

FIGS. 4 and 5 depict a shoe 36 having four tension straps 38*a*, 38*b*, 38*c*, and 38*d*. The shoe has an on/off power switch button 40 and four tension control units 42*a*, 42*b*, 42*c* and 42*d*, each having a battery-powered, two-way rotary motor. Disposed in the heal of the shoe are a pressure switch and memory chip 44 which are activated when the wearer steps in the shoe. Electric wires 45 connect the memory to four shoe control panels, each of which comprise a "Set" button 46, a "T" button 48 and an "R" button 50, and each of which controls one of the four tension control units. The Set button 46, which is located in the cushioned collar of the shoe in the upper ankle area, locks in the desired fit of the shoe by initiating storage of the desired value of tension for each strap in the memory chip when the shoe is placed on the foot for the first time, and retrieving these desired values when the shoe is worn again later.

The straps 38 are preferably made of strong fiber with very little elasticity for a strong hold. They are also preferably replaceable, allowing the shoe to continue to be worn the event that the straps become frayed or cut.

Figure 6:
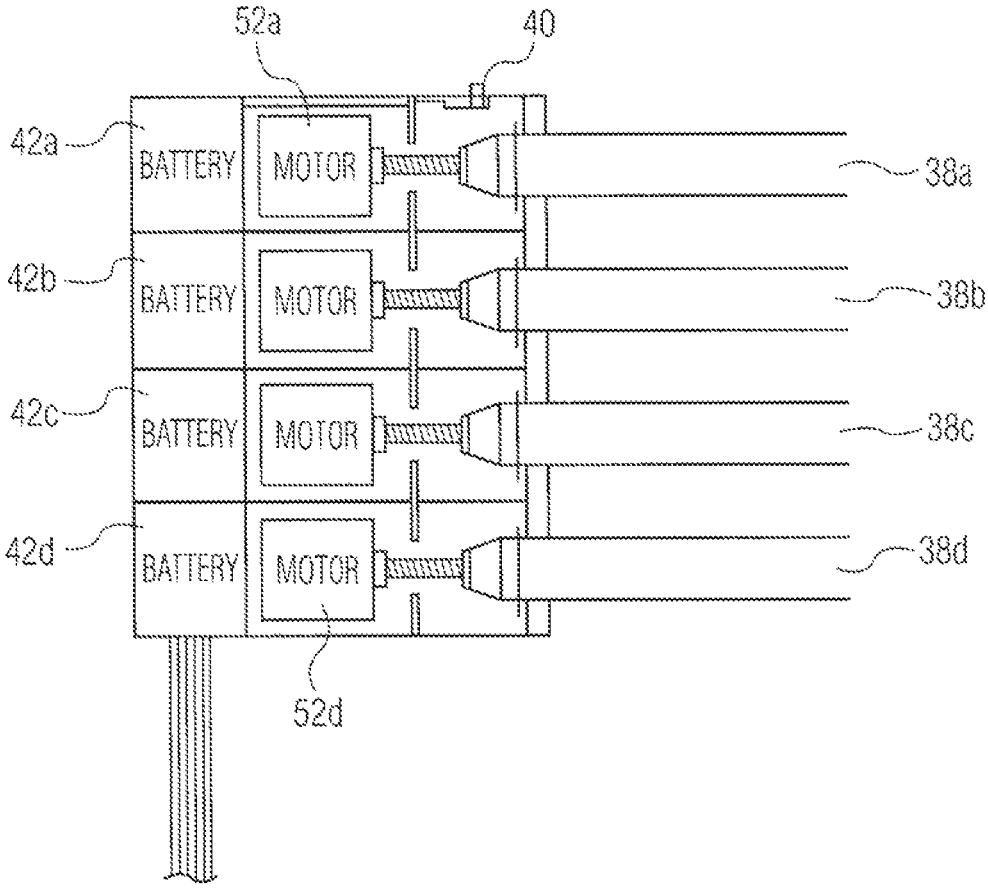
FIG. 6 is a detailed diagram showing the strap tighteners for four shoe straps.

FIG. 6 shows details of the "power station" which includes the four tension control units 42*a*-42*d* and the push button power switch 40. Each tension control unit has its own battery and two-way motor 52, both of which are preferably replaceable. When the motor rotates either clockwise or counter clockwise, it turns a screw, increasing or decreasing the tension in the corresponding strap 38.

The wiring between the controls and the tension control units is built into the show and not exposed in any way.

Figure 7A:
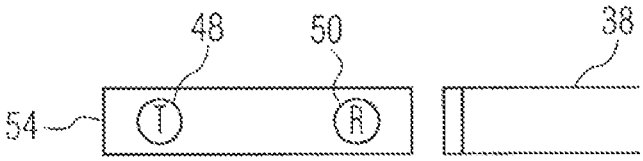
FIG. 7, comprised of FIGS. 7A, 7B and 7C, is a detailed diagram showing a control panel and a corresponding strap, indicating the manner in which these elements are connected in the embodiments of FIGS. 4 and 5.
Figure 7B:
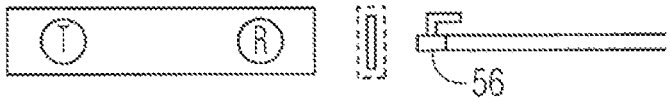
Figure 7C:
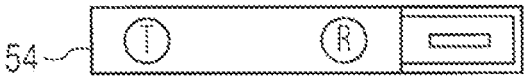

FIG. 7, comprised of FIGS. 7A, 7B and 7C, shows details of one control panel 54 and a corresponding strap 38, both of which can be individually removed and replaced. As shown in FIG. 4, the control panel is located on the outside of the shoe in the outer ankle area. FIG. 7A shows the control panel 54 with the buttons 48 and 50, together with the trap 38, in place. FIG. 7B shows the strap 38 disconnected at its end hook 56 to allow replacement. FIG. 7C shows the control panel 54 being removed for replacement.

There has thus been shown and described a novel self-tightening shoe which fulfills all the objects and advantages sought therefor. Many changes, modifications, variations and other uses and applications of the subject invention will, however, become apparent, to those skilled in the art after considering this specification and the accompanying drawings which disclose the preferred embodiments thereof. All such changes, modifications, variations and other uses and applications which do not depart from the spirit and scope of the invention are deemed to foe covered by the invention, which is to be limited only by the claims which follow.

What is claimed is:

1. A self-tightening shoe comprising, in combination:

(a) a shoe sole;

(b) a shoe upper attached to said sole and having two opposite lateral sides and an opening between them for inserting a foot;

(c) at least one shoe strap, extending from one side of said shoe upper to the other, for tightening the shoe on a foot;

(d) an electric battery;

(e) at least one strap tightener, coupled to said battery and to a respective one of said shoe straps, for tightening the respective shoe strap in response to a control signal;

(f) an electronic logic device, coupled to said battery and to said at least one strap tightener, for producing said control signal for each strap tightener so as to shorten the length of the respective shoe strap to a desired value of tightness; and (g) an electronic memory, coupled to said logic device, for storing the desired value of tightness for each respective shoe strap and providing a representation of the desired value to said logic device.

2. The shoe defined in claim 1, wherein said at least one strap tightener is disposed on, and connected to the shoe sole.

3. The shoe defined in claim 1, wherein said at least one shoe strap has two opposite ends and wherein one of said ends is connected to said strap tightener.

4. The shoe defined in claim 2, wherein said at least one shoe strap has two opposite ends and wherein each end is connected to a respective opposite side of the shoe.

5. The shoe defined in claim 1, wherein said at least one shoe strap has two opposite ends and wherein at least one of said ends is connected to the sole of the shoe.

6. The shoe defined in claim 1, having a plurality of shoe straps and wherein said shoe straps are arranged in adjacent, substantially parallel relationship on said shoe.

7. The shoe defined in claim 1, wherein said strap tightener includes an electric motor powered by said battery.

8. The shoe defined in claim 7, wherein said strap tightener includes an electric switch, responsive to said control signal, for controlling electric power applied to the electric motor.

9. The shoe defined in claim 1, further comprising a control panel coupled to said logic device for manually entering at least one command, and wherein said logic device is responsive to said command to take the commanded action.

10. The shoe defined in claim 9, wherein said command is to store a current value of tightness and wherein said logic device is responsive to said command to store the current value of tightness in said memory.

11. The shoe defined in claim 9, wherein said command is to set the tightness to the desired value and wherein said logic device is responsive to said command to retrieve said desired value of tightness from said memory and to produce a control signal causing said strap tightener to set the tightness to said desired value.

12. The shoe defined in claim 9, wherein said command is to tighten a respective shoe strap, and wherein said logic device is responsive to said command to produce a control signal causing said strap tightener to tighten the respective shoe strap.

13. The show defined in claim 9, wherein said control panel includes a switch disposed inside the shoe and configured to be contacted by a heel of a foot when the foot is inserted in the shoe.

14. The shoe defined in claim 9, wherein said command is to loosen a respective shoe strap, and wherein said logic device is responsive to said command to produce a control signal causing said strap tightener to loosen the respective shoe strap.

15. The shoe defined in claim 9, wherein said control panel includes a manually operable start and stop button for starting and stopping each respective strap tightener.

16. The shoe defined in claim 1, wherein said battery is attached to said shoe sole.

17. The shoe defined in claim 1, further comprising a battery charger electrically coupled to said battery.

18. The shoe defined in claim 17, wherein the battery charger includes a coil for receiving power by magnetic induction.

19. The shoe defined in claim 17, wherein the battery charger includes a transducer for converting mechanical energy imparted by a foot into electrical energy.

* * * * *